United States Patent [19]

Blessing

[11] 4,092,020

[45] May 30, 1978

[54] SHADEMARKER

[75] Inventor: Hubert Blessing, Dallas, Tex.

[73] Assignee: Levi Strauss & Co., San Francisco, Calif.

[21] Appl. No.: 750,806

[22] Filed: Dec. 15, 1976

[51] Int. Cl.[2] ..... B65H 29/46

[52] U.S. Cl. ..... 270/31; 101/92

[58] Field of Search ..... 270/30–31; 101/91–92, 375

[56] References Cited

U.S. PATENT DOCUMENTS

| | | | |
|---|---|---|---|
| 2,756,992 | 7/1956 | Rosenthal | 270/31 X |
| 3,939,766 | 2/1976 | Darwin | 270/31 X |

*Primary Examiner*—Edgar S. Burr
*Assistant Examiner*—A. Heinz
*Attorney, Agent, or Firm*—Limbach, Limbach & Sutton

[57] ABSTRACT

A fabric shademarker of the type which is mounted on a fabric spreading machine and which prints identifying indicia such as numerals on the reverse side of the fabric as it is spread, layer by layer, on a spreading table and which is characterized by the improvement of means for synchronizing the rotation of the printing and impression cylinders and further in that the impression cylinder has raised pads spaced along its circumferential surface which mate with corresponding raised characters on the printing cylinder so that tension, which would otherwise be introduced along the longitudinal edges of the fabric web which is being spread because of the unequal friction exerted on the fabric by the impression and printing cylinders, is equalized due to the fact that the slack portions of the fabric web drape between the raised pads on the impression cylinder and the taut portions of the fabric web span the chord between the circumferentially adjacent raised pads on the impression cylinder with the net tension thereby being averaged to zero. In the preferred embodiments of the invention, the pads on the impression cylinder and the raised characters on the printing cylinders are arranged in corresponding helixes. The impression cylinder, printing cylinder, and inking cylinders are all driven by motorized means which also drive the spreader so that the fabric is spread tensionless.

8 Claims, 13 Drawing Figures

SHADEMARKER

BACKGROUND OF THE INVENTION

This invention relates to textile marking devices and more particularly to a fabric shademarking device.

As is well known in the garment industry, it is desirable to stamp identifying indicia, ordinarily sequential numbers, along the backside of the fabric web as it is being spread on a spreading table by a fabric spreading apparatus. The purpose of doing this is so that when a stack of cloth parts are cut out from the layers of spread fabric, the pieces of a single layer can be identified and combined together to form a single garment to eliminate any possibility of variations in the color shade of the fabric from layer to layer.

Numerous attempts have been made to produce successful shademarkers. Some such attempts are described in U.S. Pat. Nos. 3,902,413 (Powell et al.), 3,951,397 (Rice) and 3,939,766 (Darwin). In the shademarker described in U.S. Pat. No. 3,939,766, the shademarker consists of a frame which carries printing wheels having a series of indicia printing elements on the peripheries thereof, and which are rotated by movement of the fabric in engagement with the printing wheels. A mechanism is provided for applying ink only to a selected printing element so that all of the printing elements engaged the fabric but only the selected element imprints its image thereon. Means are further provided for rotating the printing wheel in synchronism with the mechanism for applying the ink so that the printing element which is to be inked may be manually selected. The cloth as it passes through the shademarker, which incidentally is mounted on the fabric spreader, passes over an anvil roller on one side of the fabric while a pair of printing wheels press against the fabric on the side opposite from the anvil roller to imprint the shademarking indicia. The motion of the fabric through the shademarker rotates the printing wheels and the inking mechanism as well as an ink roller which inks the inking mechanism.

There are several problems with this type of shademarker. The first problem arises in that a substantial amount of tension is introduced into the fabric because of the fact that the fabric as it passes through the shademarker and onto the spreading table is being used as the motivating force for rotating the printing wheels. This can cause the fabric to be distorted in the spread if it is a loosely woven fabric such as a knit, for example. Another problem is that the tension can produce smearing in the imprinting of the shademarking indicia. Still another problem is that the tension produced in the fabric by means of its contact with the anvil roller and printing wheels may be unevenly distributed across the width of the fabric thereby producing a nip or tuck in the fabric prior to its passing through the printing section of the shademarker. This can result in an interruption in the printed image which renders it unrecognizable.

SUMMARY OF THE INVENTION

The above and other disadvantages of prior art shademarking devices are overcome by the present invention of an improved fabric shademarker of the type which is mounted on a fabric spreading machine and which has at least one inked, rotatable printing cylinder having raised characters on its circumferential surface and an opposed impression cylinder with the fabric web being imprinted with selected characters across its width from the printing cylinder as the fabric web is fed between the printing cylinder and the impression cylinder during the spreading operation. The improvement of the invention comprises means for synchronizing the rotation of the printing cylinder with the rotation of the impression cylinder and raised pads on the circumferential surface of the impression cylinder, each of the raised pads being positioned to mate with at least one corresponding raised character on the printing cylinder. By this mechanism, the tension introduced along the longitudinal edges of the fabric web because of the impression and printing cylinders is equalized. This is due to the fact that the slack portions of the fabric web will drape between the raised pads and the taut portions of the fabric web will span the chord between the circumferentially adjacent raised pads.

In one preferred embodiment of the invention, the means for synchronizing the rotation of the printing and impression cylinders is motorized and drives the impression and printing cylinders, without regard to the force of the cloth fabric as it is being spread, so as to feed the fabric web through the shademarker. This is in contrast to the prior art shademarkers in which the movement of the cloth itself as it was being spread forced the rotation of the impression and printing cylinders. By this means, no tension is introduced into the fabric and smearing of the printed characters on the fabric is substantially reduced. This motorized means also drives the spreader itself to further reduce any tension which might otherwise be introduced into the fabric. In a particular preferred embodiment, the raised characters on the printing cylinder and the raised pads on the impression cylinder are arranged in corresponding helixes to thereby cause any taut or slack portions in the fabric to be moved transversely with the ultimate effect being that the tension across the web is equalized. The raised characters or the raised pads are preferably resilient. In the preferred embodiment, the spacing between the impression cylinder and the printing wheels is controllable to take into account different fabric web thicknesses. Furthermore, by controlling the spacing between the impression roller and the printing wheels, the fabric may be paid out more or less quickly.

In order to allow the fabric web to be initially fed between the impression cylinder and the printing cylinders, the impression cylinder is pivotally mounted in the shademarker so that it can be swung from a closed position, closely adjacent the printing cylinder, to an open position, away from the printing cylinder. Timing belt means are provided for maintaining the synchronization between the impression cylinder and the printing cylinder when the impression cylinder is swung between the closed and open positions so that upon being swung back from an open position to a closed position, the raised pads of the impression cylinder will still be mated with the corresponding raised characters of the printing cylinder.

It is therefore an object of the present invention to provide a shademarker attachment for a fabric spreading machine which does produce a nip in the fabric during the shademarking processing without putting tension or distortion to neither axis of the fabric.

It is another object of the invention to provide a shademarker attachment for a spreading machine which equalizes the tension in the fabric web during the shademarking operation.

It is still another object of the invention to provide a shademarker for a fabric spreading machine which is motorized to produce no tension in the fabric both transversely and longitudinally as the fabric is spread and simultaneously shademarked.

The foregoing and other objects, features and advantages of the invention will be more readily understood upon consideration of the following detailed description of certain preferred embodiments of the invention, when taken in conjunction with the accompanying drawings.

DETAILED DESCRIPTION OF THE PREFERRED EMBODIMENTS

Figures 1, 2:
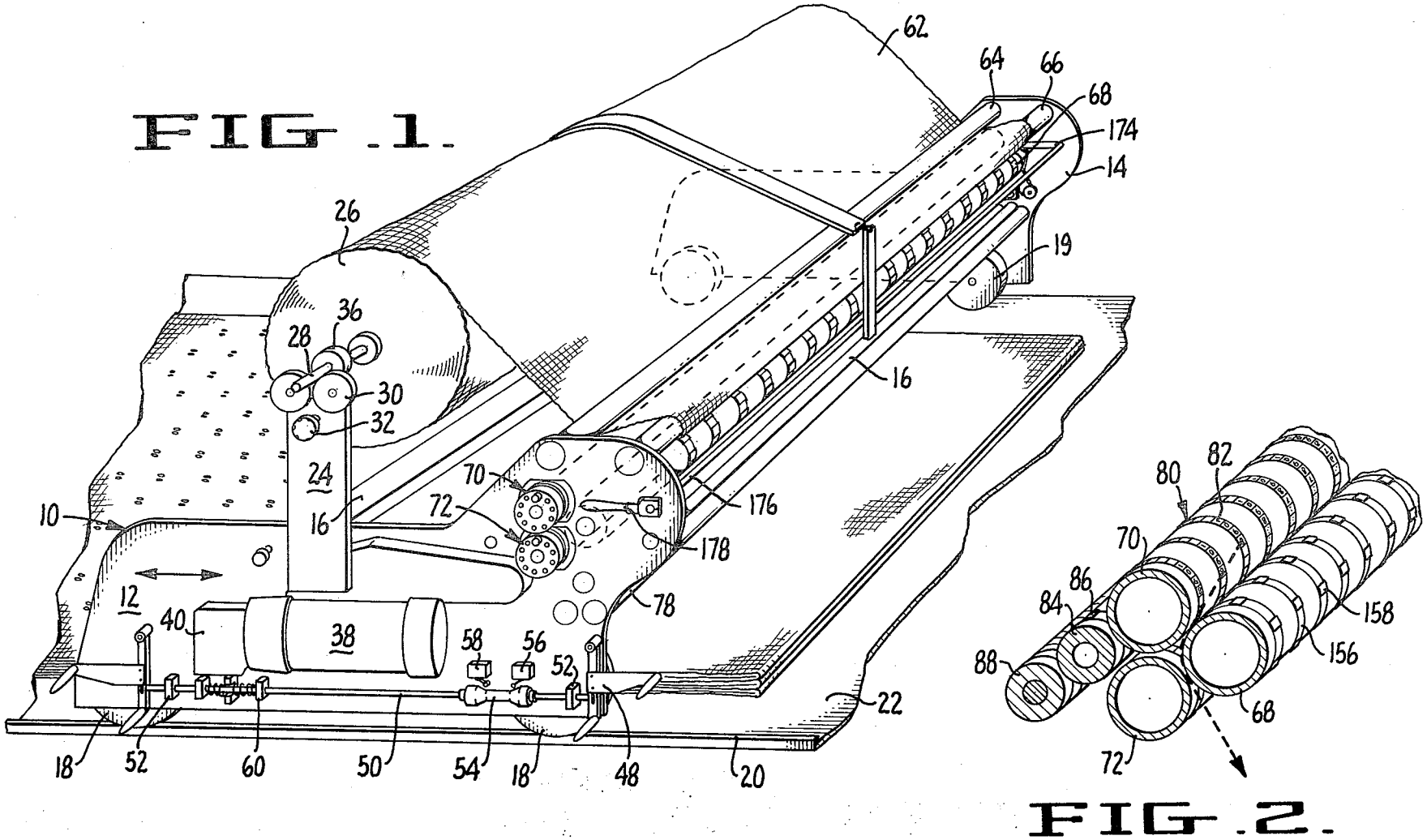
FIG. 1 is a perspective view with portions broken away of the shademarker and spreading apparatus according to the invention.
FIG. 2 is a diagrammatic perspective view of the printing cylinders, impression cylinders, inking roller and inker of the embodiment depicted in FIG. 1.
Figure 3:
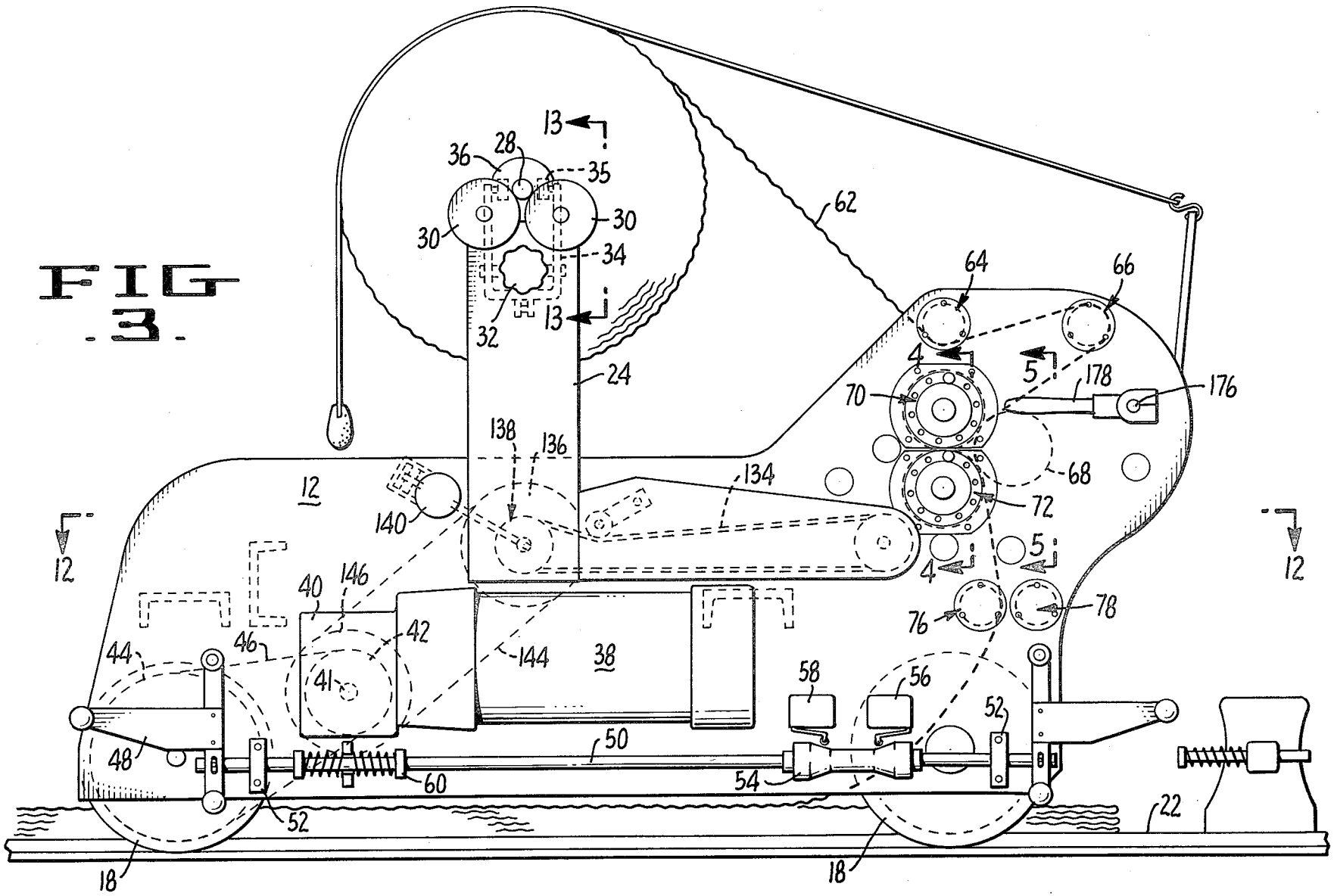
FIG. 3 is a vertical view of the left side of the shademarker according to the invention depicted in FIG. 1.

Referring now more particularly to FIGS. 1 and 3, the invention is supported in a spreader carriage 10 which is composed of a vertical left side plate 12 and a vertical right side plate 14, which are held in a spaced apart position by crossbar supports 16. The spreader moves along on wheels 18 and 19 rotatably mounted in the side plates 12 and 14, respectively. The wheels 18 roll on a rail 20 mounted on a horizontal and planar spreading table 22. The side plate 14 has rubberized wheels 19 which are rotatably supported by it and which roll along the flat surface of the table 22. The spreading table 22 can extend for any length such as a length of fifty feet, for example. The width of the table 22 is slightly larger than the spreader 10 to accommodate the width of a bolt of cloth 26. The bolt of cloth 26 is carried on an axle 28 which is rotatably supported at each end on a pair of rollers 30 mounted at the upper end of an upright leg 24 attached to each of the side plates 12 and 14.

Figure 13:
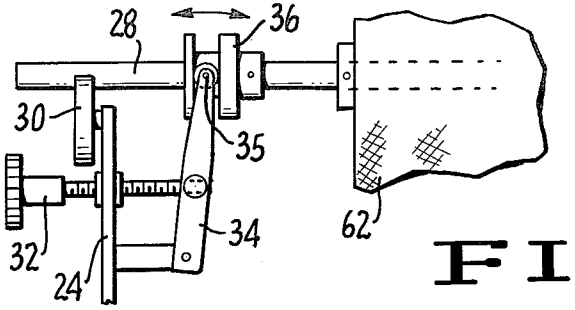
FIG. 13 is a vertical, sectional view, taken generally along the line 13—13 in FIG. 3.

Because the position of the shademark 10 is fixed with respect to the width of the spreading table 22 due to the fact that the wheels 18 ride on side rails 20, it is sometimes necessary to shift the bolt 26 transversely in order to properly align it and center it in the shademarker and on the table 22. Referring now more particularly to FIGS. 1 and 13, a mechanism for accomplishing this is disclosed. A cylindrical race 36 is mounted on the left end of the axle 28 between the bolt 26 and the rollers 30. A lever arm 34 is pivotally mounted at one end to the vertical leg 24 and carries a forked pair of rollers 35 at its other end. The rollers 35 are captured by race 36. A threaded shaft 32 having a knob at one end is rotatably mounted in the vertical leg 24. Its other end is threadably engaged in the mid-portion of the lever arm 34. By manually turning the shaft 32, the lever arm 34 may be rotated clockwise or counterclockwise as viewed in FIG. 13. This has the effect of moving the cylindrical race, together with the axle 28, transversely with respect to the shademarker. This allows the bolt 26 to be adjustably centered within the shademarker.

In order to propel the shademarker 10 along the spreading table 22, an electric motor 38 is coupled through a right angle and reduction gear assembly 40 which has an output shaft 41 on the opposite side of the side plate 12 from the motor 38 and the reduction gear assembly 40. A V belt pulley 42 is mounted on this shaft 41. The pulley 42 is connected to a pulley 44 by means of a V belt 46. The pulley 44 is mounted on one of the wheels 18. The motor 38 is reversible so that power transmitted to the wheel 18 by means of the pulleys 42 and 44 can thereby drive the spreader 10 in either direction along the spreading table. The motor is controlled by a pair of swing arms 48 which are pivotally mounted on the side plate 12 and which are pivotally connected at their free ends to a horizontal shaft 50 which is mounted in sliding blocks 52 attached to the side of the side plate 12. A double ended rising cam 54 is mounted on the shaft 50 to operate a pair of microswitches 56 and 58 attached to the side plate 12. When one of the arms 48 is rotated in the counterclockwise direction to shift the horizontal bar 50 the right, as viewed in FIG. 1, the rising end of the cam 54 operates the switch 58 which causes the motor 38 to rotate in the proper direction to drive the shademarker 10 to the right as viewed in FIG. 1. Conversely, when the swinging arm 48 is rotated in the clockwise direction, to shift the bar 50 to the left as viewed in FIG. 1, the rising end of the cam 54 closes the switch 56 to cause the motor 38 to drive the shademarker to the left as viewed in FIG. 1. A double ended spring 60 mounted on the side plate 12 causes the shaft 50 to center the cam 54 between the switches 56 and 58 in the absence of any force acting on the swinging arms 48.

The shademarking device of the present invention is carried by the spreader 10 and is operable to print identifying indicia on the backside of the fabric as it leaves the bolt 26 but before it is spread on the table 22. The shademarker is capable of having the indicia changed for each successive layer of cloth.

In leaving the bolt of cloth 26, the fabric web 62 is passed toward the right hand side of the spreader 10, as viewed in FIG. 3, and passes underneath a rear top roller 64. It thereafter passes over and around a forward top roller 66 and down between an impression cylinder 68 and an upper, units printing cylinder 70 and a lower, tens printing cylinder 72. The arrangement of the impression cylinder 68 with respect to the printing cylinders 70 and 72 is that the impression cylinder is to the right of the fabric web 62, as viewed in FIG. 3, and the printing cylinders 70 and 72 are to the left of the web 62, as viewed in FIG. 3. After leaving the tens printing cylinder 72, the web 62 passes between a pair of lower or bottom rollers 76 and 78. The web is thereafter dropped, tensionlessly, to the table 22 as the spreader 10 moves along the table. As will be explained in greater detail hereinafter, the impression cylinder 68 and the printing cylinders 70 and 72 are driven by the motor 38 to pull the web 62 through the shademarker so that the web 62 which falls between the rollers 76 and 78 has substantially no longitudinal tension exerted on it. It is paid out in synchronism with the speed of the spreader 10 as it moves along the table 22. As will be explained hereinafter, the printing cylinders 70 and 72 each have a plurality of bands 80 of raised printing characters 82. These bands extend around the cylinders circumferentially and are spaced apart along the length of the cylinders, that is transversely across the width of the shademarker. Each band 80, as mentioned above, is made up of a plurality of raised characters 82 in segments. The characters constitute a sequence of indicia such as a sequence of numbers around the band 80. Individual characters are selectively inked by raised pads 86 spaced about the circumference of an inking transfer cylinder 84 spaced approximately parallel to the impression cylinder 68 and on the opposite side of the printing cylinders 70 and 72 from the impression cylinder 68. The rotational orientation of the cylinders 70 and 72 may be selectively altered, as will be explained in greater detail hereinafter with respect to the location of the raised inking transfer pads 86 on the inking transfer cylinder 74, so that individual characters on the printing cylinders 70 and 72 may be selectively inked to the exclusion of the remaining raised characters on the printing cylinders 70 and 72.

Ink is applied to the raised inking transfer pads 86 by means of an ink roller 88 which is positioned adjacent to the inking transfer cylinder 84. The ink roller 88 constitutes a permanent supply of ink. All of the rollers and cylinders 64 – 78, inclusive, and 84 and 88 all extend parallel to each other and are horizontal with respect to the table 22. They also extend transversely across between the sideplates 12 and 14 and are rotatably supported between them.

Figure 4:
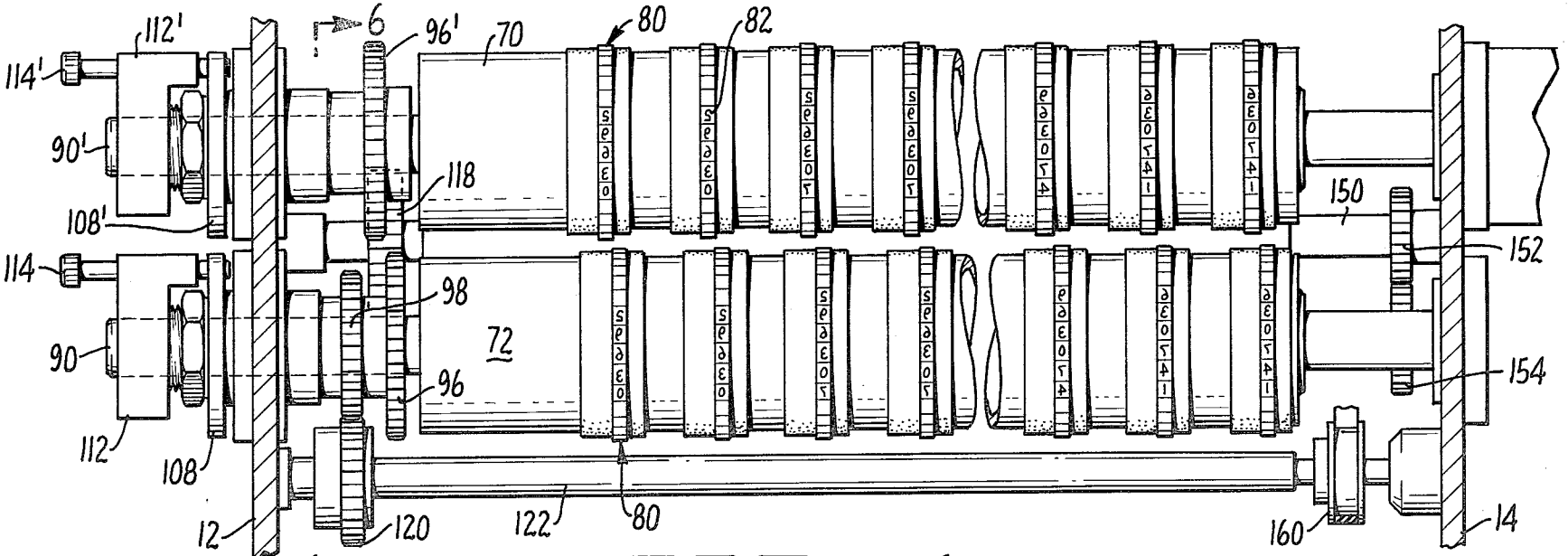
FIG. 4 is a vertical, sectional view, with portions broken away taken generally along the line 4—4 in FIG. 3.
Figure 5:
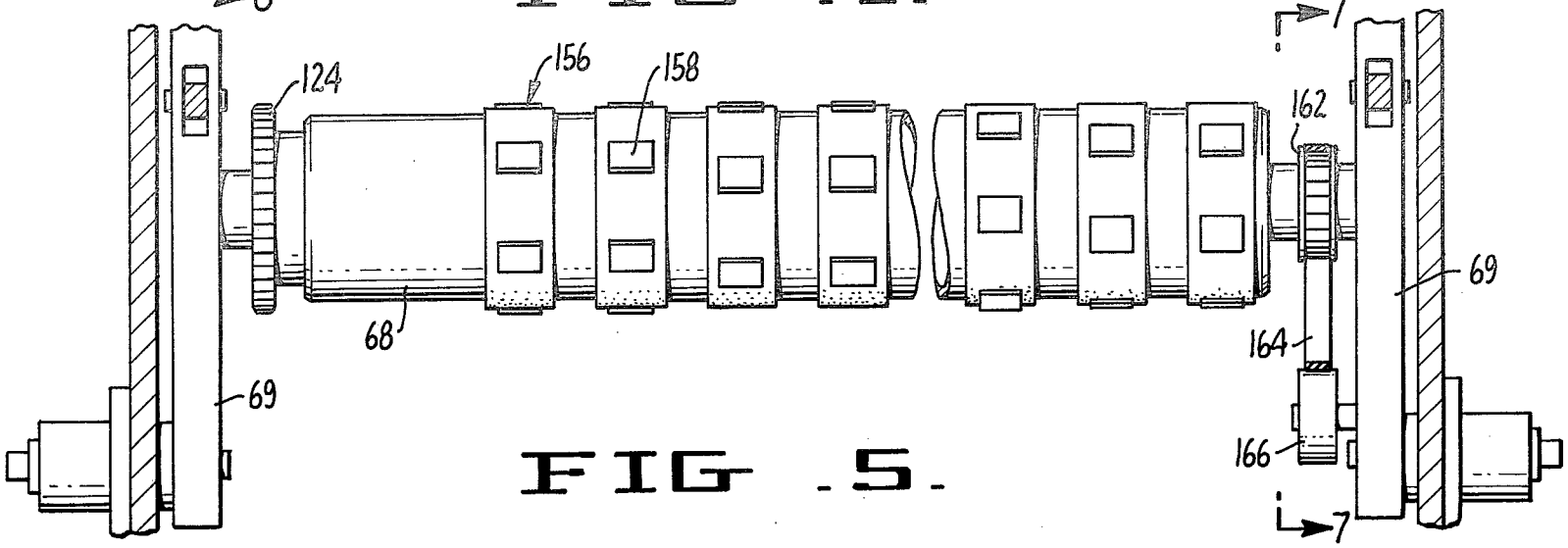
FIG. 5 is a vertical, sectional view, with portions broken away taken generally along the line 5—5 in FIG. 3.
Figure 6:
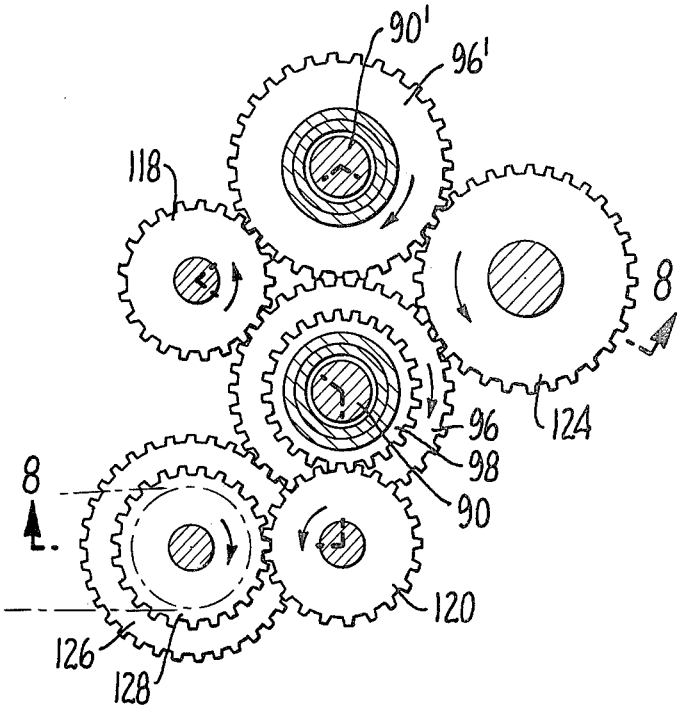
FIG. 6 is a vertical, sectional view, with portions broken away taken generally along the line 6—6 in FIG. 4.
Figure 9:
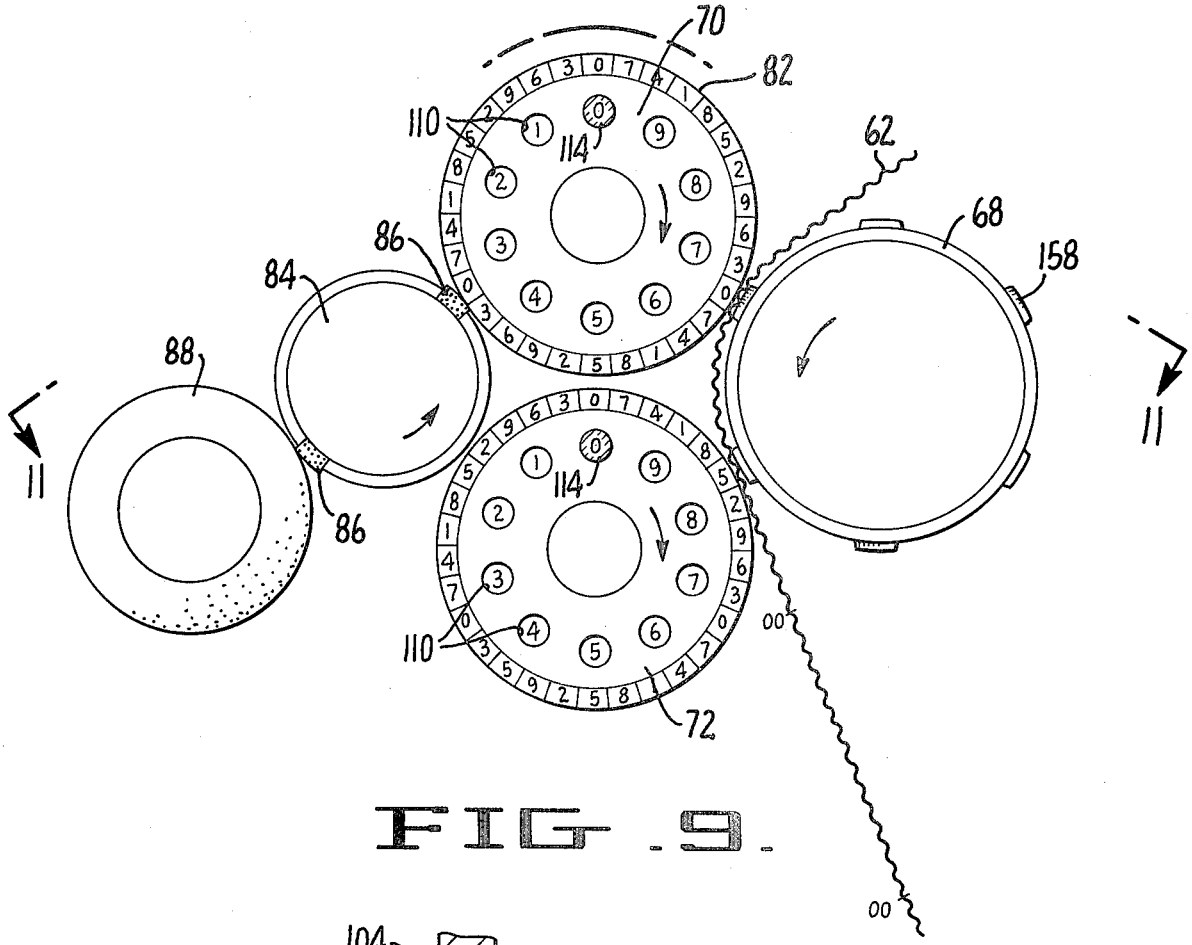
FIG. 9 is a vertical, diagrammatic view of the printing cylinder, impression cylinder, inking cylinder and ink roller of the shademarker embodiment depicted in FIG. 1.
Figure 11:
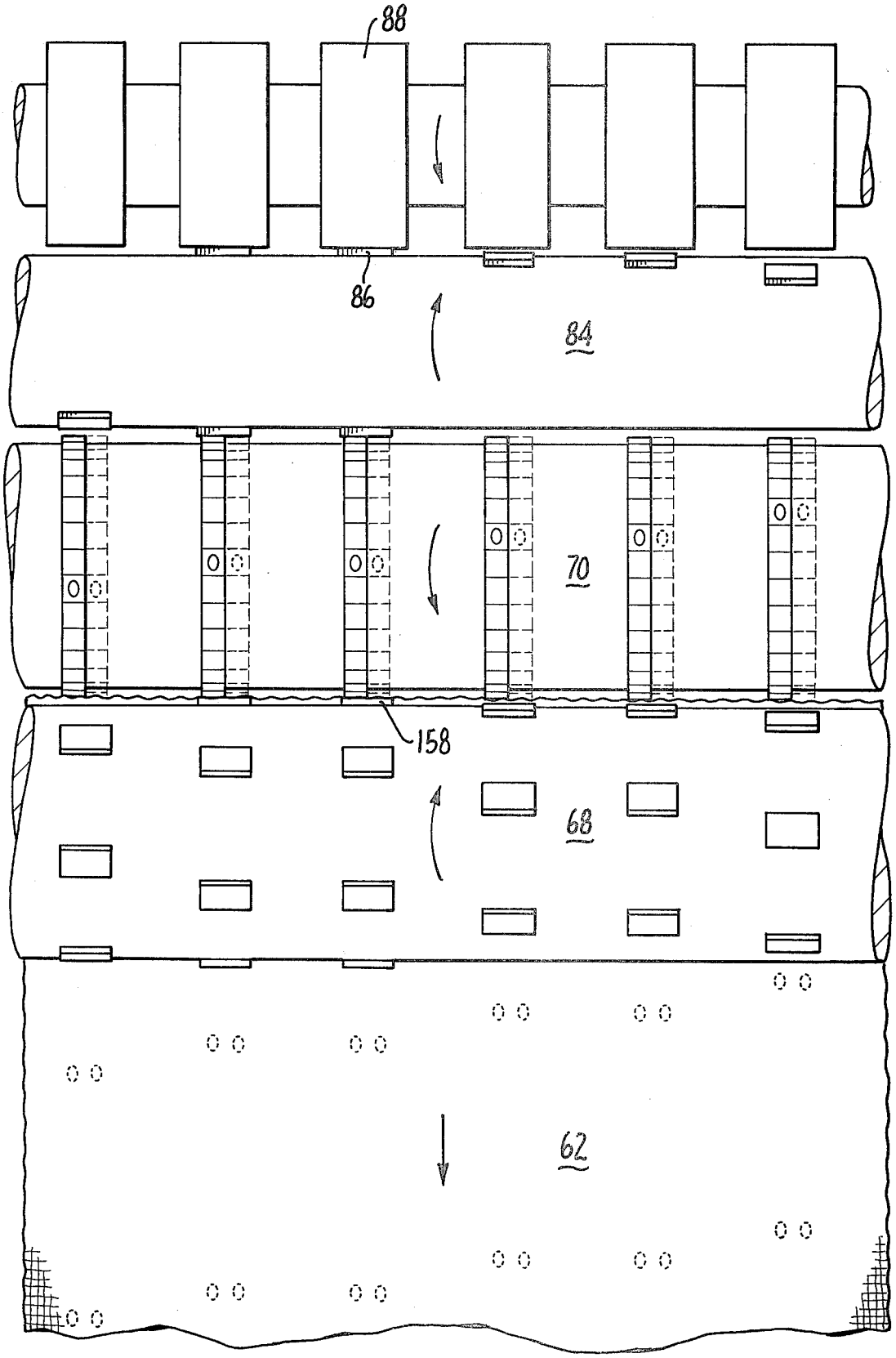
FIG. 11 is a diagrammatic, sectional view, taken generally along the line 11—11 in FIG. 9.

Referring now more particularly to FIGS. 4 and 9, it will be seen that the raised character band 80 of the units cylinder 70 is staggered axially from the raised character band 80 of the tens cylinder 72 so that the band 80 of the cylinder 70 is slightly to the left of the band 80 of the cylinder 72 as viewed in FIG. 4. This allows the numerical indicia on the band 80 of the cylinder 72 to be printed in the left column on the fabric web 62, that is the tens place, and the character from the band 80 on the cylinder 70 to be printed in the right hand column on the web 62, that is the units column. For convenience in the illustration, as viewed in FIG. 11, the numerical indicia imprinted on the web 62 is 00. Any numerical combination could be imprinted, however, and typically the numerical indication would be the number of the layer stacked on the table 22. As viewed in FIG. 11, the left hand character band 80 is the character band mounted on the cylinder 70 whereas the character band 80 appearing to the right in the Figure is the band which is mounted on the cylinder 72. It will be appreciated that when the numbers are imprinted on the fabric, their order will appear to be reversed.

Figure 10:
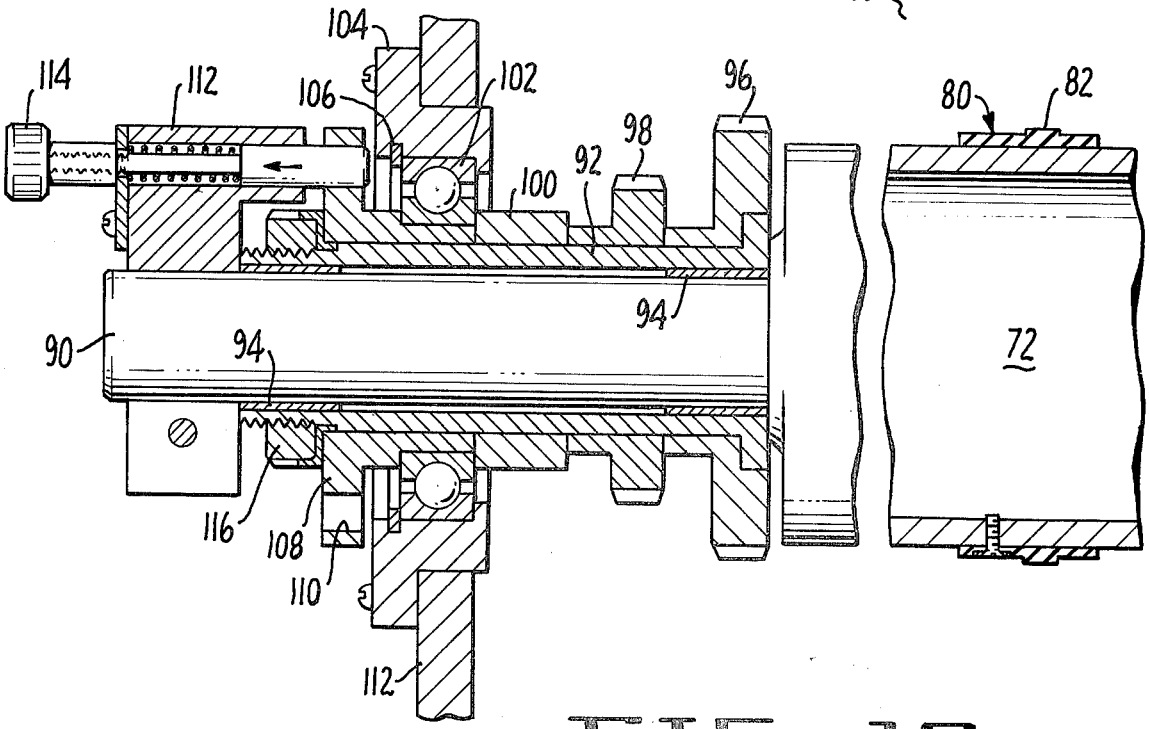
FIG. 10 is an enlarged, vertical, sectional view, with portions broken away, of the indexing mechanism for positioning the raised characters on the printing cylinders with respect to the inking roller of the shademarker according to the invention depicted in FIG. 1.

Referring now more particularly to FIG. 10, the means by which the characters 82 may be indexed relative to the impression cylinder 68 and the inking cylinder 84 will be described. It will be understood that the same mechanism is used for rotating the cylinders 72 and 70 and, therefore, only a single description will be given for the mechanism for indexing the cylinder 72, it being understood that like components will be designated by primed numerals for the cylinder 70. The cylinder 72 is mounted on a rotational shaft 90 which is co-axially mounted at its left end within a cylindrical sleeve 92. Sleeve bearings 94 at opposite ends of the interior of the sleeve 92 reduce the friction between the shaft 90 and the sleeve 92. Next to the plate 95, in a direction away from the cylinder 72, is mounted a first toothed gear 96. Adjacent this gear 96 is a smaller diameter gear 98 and next to the gear 98 is a spacer ring 100. The spacer ring 100 bears against one side of a bearing race and bearing assembly 102 which is held within a collar 104 mounted in the side plate 12. The bearing race 102 is retained within the collar by means of a circular clip or retaining ring 106 mounted in the outward end of the collar 104. The sleeve 92 is supported within the bearing race 102 on a circular, flanged sleeve 108. The sleeve 108 has a plurality of circumferentially spaced transverse holes 110 which receive a spring-loaded pin 114 mounted in a circular member 112 at the end of the shaft 90. By rotating the shaft 90 through the use of the member 112, the pin 114 may be selectively aligned with any one of a plurality of the holes 110. This fixes the angular orientation of the cylinder 72 with respect to the gears 96 and 98 mounted on the sleeve 92. As will be explained in greater detail hereinafter, this also indexes the characters 82 mounted on the circumferential surface of the cylinder 72 with respect to the impression cylinder 68 and the inking transfer cylinder 84 because all of these various cylinders are interconnected by means of gears. A retaining nut 116 on the outer end of the sleeve 92 bears against the sleeve 108 at the end of the shaft 90 to hold the whole assembly rigidly between the side plates 12 and 14. Furthermore, the retaining nut 116 is used to time the blade cylinders 72 and 70 to the remainder of the mechanism.

Referring now more particularly to FIGS. 4, 5, 6 and 8, the gearing connections between the various rotative elements will now be described. The gear 96 of the printing cylinder 72 meshes with a gear 118 of the inking transfer cylinder 84. The corresponding gear 96′ of the printing cylinder 70 also meshes with the gear 118 but does not mesh with the gear 96. The gear 98 of the printing cylinder 72 meshes with a gear 120 mounted on a synchronous registration shaft 122 used in conjunction with the impression cylinder 68, as will be explained in greater detail further in this application. The impression cylinder 68 has a gear 124 mounted on its end which is closest to the side plate 12 and which meshes with the gear 96 and 96′. As best viewed in FIGS. 6 and 8, the gear 96 meshes with a gear 126 and the gear 120 meshes with a gear 128. The gears 126 and 128 are mounted on a single shaft 130 via one revolution clutches, clockwise and counterclockwise respectively. This facilitates driving the printing unit in one direction only, regardless of the linear direction of motion of the spreading unit in reference to the table. To prevent freewheeling of the two printing cylinders 70 and 72 together with the impression cylinder 68 upon fast stopping of the spreader shademarker, an electric brake with its two halves mounted to the side blade 12 and cylinder 70 respectively when energized absorbes the rotary energy of the printing unit. By controlling the clutch 131 the drive from the shaft 531 may be selectively engaged and disengaged. The shaft 130 is rotatably mounted in the side plate 12 and the end of the shaft 130 which is on the side of the side plate 12 opposite from the gears 126 and 128 has a pulley 132 mounted on it. The pulley 132 is driven by a belt 134 whose other end is entrained around a pulley 136.

Figure 12:
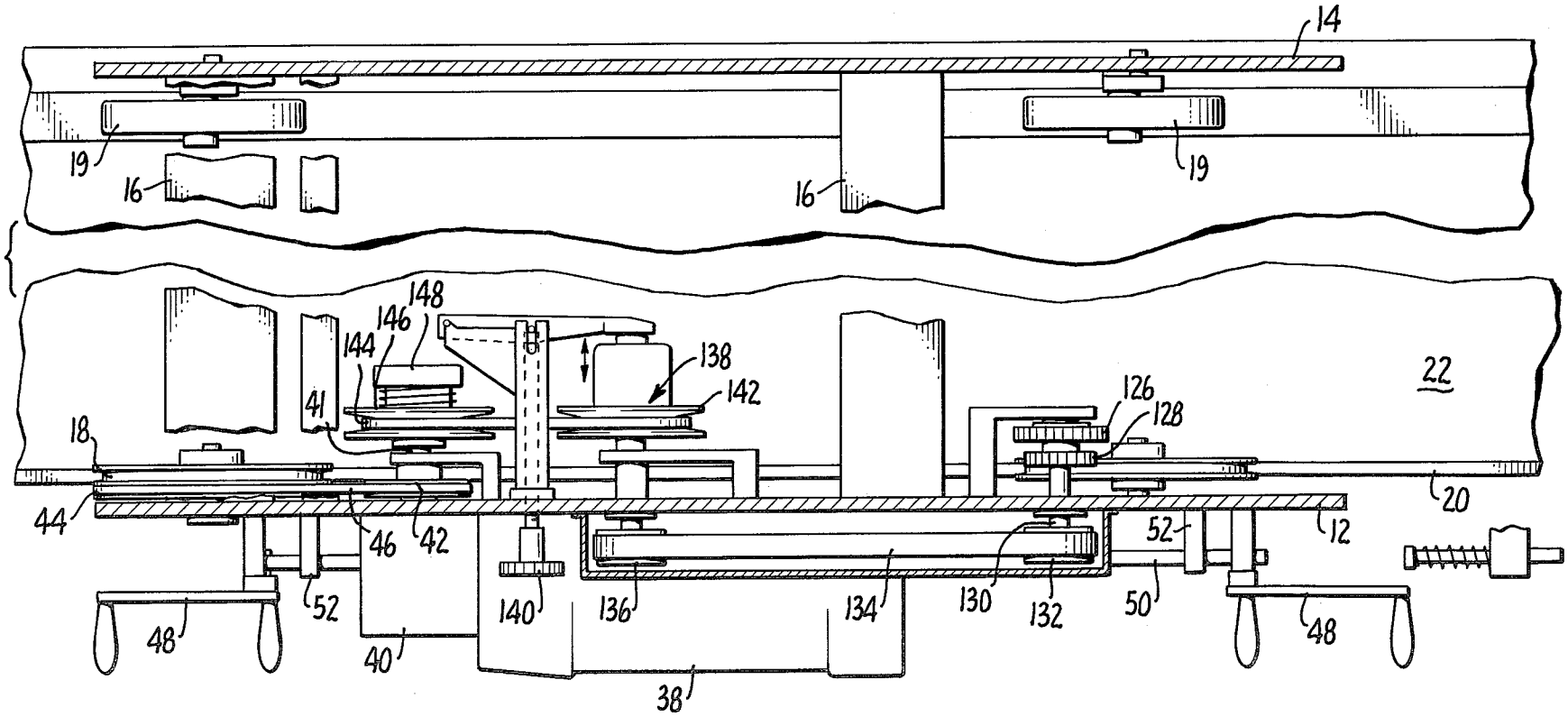
FIG. 12 is a horizontal, sectional view, with portions broken away taken generally along the line 12—12 in FIG. 3.

Referring now more particularly to FIG. 12, it can be seen that the pulley 136 is the output pulley from a variable speed mechanism 138. The variable speed mechanism 138 includes, in addition to the pulley 136, a pulley 142 having V-shaped plates and whose effective diameter may be varied by the adjustment of a lever arm through a knob 140. By turning the knob 140, the effective diameter of the pulley 142 may be continuously varied. A belt 144 is entrained around the pulley 142 and around a pulley 146 connected through a electrically operated clutch 148 to the output shaft 41 of the reduction gear assembly 40. Thus, the operator can, by appropriate electrical signals to the clutches 148 and 131, cause the printing cylinders and impression cylinder and inking cylinder, as well as the ink roller, to all be rotatably driven by the motor 38 at a speed which is adjustable by means of the knob 140 so that the shademarking mechanism can be placed in synchronism with the speed of the spreader carriage 10.

It should also be noted that the inking transfer cylinder 84 is mounted on a shaft 150, together with the gear 118. At the opposite end of the shaft 150 from the gear 118 is mounted a gear 152 which meshes with a gear 154 mounted on the ink roller 88, all as best viewed in FIG. 4. Thus, all of the rotatable elements of the shademarker are driven by the motor 38 rather than by being rotated by the force of the cloth web moving through the shademarker as it is being spread.

To this point, the shademarker of the present invention is not wholly unlike the shademarker described in U.S. Pat. No. 3,939,766 (Darwin) except that the present shademarker is power driven whereas the Darwin shademarker is operated by the force of the fabric web moving through the shademarker. As pointed out above, one problem with some prior art shademarkers is that the fabric web in passing through the shademarker acquires a nip across the width of the fabric due to uneven tension on the longitudinal edges of the fabric web. This problem is avoided in the present invention by having bands 156 spaced axially along the length of the impression cylinder 68. The bands encircle the impression cylinder and have a plurality of raised pads 158. The locations of the pads 158 about the circumference of the impression cylinder 68 are selected to coincide with the point where the raised characters 82 of the printing cylinder band 80 will press against the fabric web 62. Thus, as the fabric web passes between the printing cylinders 70 or 72 and the impression cylinder 68, it is contacted primarily by being pressed between the raised characters 82 and corresponding raised pads 158 on the bands 156. The indexing mechanisms for rotating the printing cylinders 70 and 72 with respect to the inking transfer cylinder 84 are so dimensioned that the raised characters 82 will also fall into alignment with at least one of the raised pads 158 on a particular band 156.

The means by which this mechanism eliminates the uneveness and longitudinal tension of the fabric web is that as a particular longitudinal edge of the fabric web is drawn taut in passing over the impression cylinder 68, it will span the chord between the circumferentially adjacent pads 158. As the longitudinal edge grows slack it will tend to drape between circumferentially adjacent pads 158. The net effect of this operation is that the longitudinal tension on both edges will eventually even out. With a convention impression cylinder or anvil roller as it is sometimes called in some shademarkers, there is no provision made for taking up such slack and it is cumulatively built up into a nip which finally grows to such a size that it makes a fold, thereby interrupting the shademarking imprintation on the fabric web. In the preferred embodiment of the invention, the pads 158 take a modified helical pattern, as is best viewed in FIG. 5 and FIG. 11. In this embodiment, the raised characters 82 must also have a helical arrangement. The helical arrangement of the raised characters 82 and the raised pads 158 is with respect to the longitudinal axis of the cylinders 70, 72 and 68. That is, the pads tend to follow a helix which encircles the cylinders. In other embodiments, other patterns may also be used, such as a herring bone pattern. It is only necessary that the pattern taken by the pads of the raised characters on the printing cylinders be opposite in direction from the pattern used for the raised pads on the impression cylinder. The purpose of either of these two patterns is to have the effect of "walking" the uneveness of the fabric web from the center of the fabric web to the outside edge, thereby accelerating the equalization of the tension in the longitudinal edges of the fabric web.

The means by which the raised characters 82 are selectively inked is best illustrated in FIG. 9. The inking transfer cylinder 84 has two raised portions 86 which are spaced 180° apart. By selectively setting the angular orientation of the printing cylinders 70 or 72 with respect to the inking transfer cylinder 84, a selected raised character may be thereby placed into circumferential alignment with one of the raised pads 86. The printing cylinders 70 and 72 have three sets of numbers spaced about their circumference, in the staggered pattern as described above. The ratio of the rotational speeds of the printing cylinders 70 and 72 with respect to the inking transfer cylinder 84 is that the printing cylinders will make three complete revolutions for each two complete revolutions of the inking transfer cylinder 84. In this way, the printing cylinders 70 and 72 may be adjusted, as described above, so that a parituclar raised character will always fall in alignment with one of the raised pads 86 on the inking transfer cylinder 84 so that only that raised character is inked. It is this inked character which will then be printed upon the fabric web 62 as it passes between the impression cylinder 68 and the printing cylinders 70 and 72. The pads 86, as mentioned above, also contact the ink roller 88 with each complete revolution thereby acquiring sufficient ink to be transferred to the raised characters 82. The amount of ink which is transferred is carefully controlled so that smearing is avoided.

To allow the web 62 to be initially threaded between the printing cylinders 70 and 72 and the impression cylinder 68, the impression cylinder is rotatably mounted between a pair of swing arms 69 which are pivoted at their lower ends to the side plates 12 and 14. This allows the impression cylinder 68 to be moved between a closed position, closely adjacent to the printing cylinders 70 and 72, and an open position, away from the printing cylinders 70 and 72.

Toggle linkages 174 connected at one end to the swing arms 69 and at their other ends to a shaft 176 which is rotatable by means of handles 178 at either end is used to swing the impression cylinder into the closed position and open position. A microswitch 180 mounted on the side plate 14 is contacted by the swing arm 69 when the impression cylinder is in the closed position. The switch 180 is connected to the controls for the spreader carriage 10 so that the carriage cannot be accidentally operated in the shademarking mode when the impression cylinder is in the open position. It should be noted that the degree to which the impression cylinder 68 is pressed into engagement with the printing cylinders 70 and 72 is adjustable by means of adjusting the length of the toggle 174. The characters 82 or the pads 158 are preferably resilient. Because of this resiliency, the rate at which the fabric is fed between the impression cylinder and the printing cylinders may be controlled in some degree. By squeezing the impression cylinder 68 closer to the printing cylinders 70 and 72, the rate of fabric feed may be increased. This increase in rate takes place with the elastic deformation of the characters 82 or the pads 158. Conversely, by not pressing the impression cylinder 68 into close engagement with the printing cylinders 70 and 72, the feed rate of the fabric may be slowed. In this way, the slight differences in the rate of feed due to different thicknesses in the fabric web 62 may be compensated.

Figure 7:
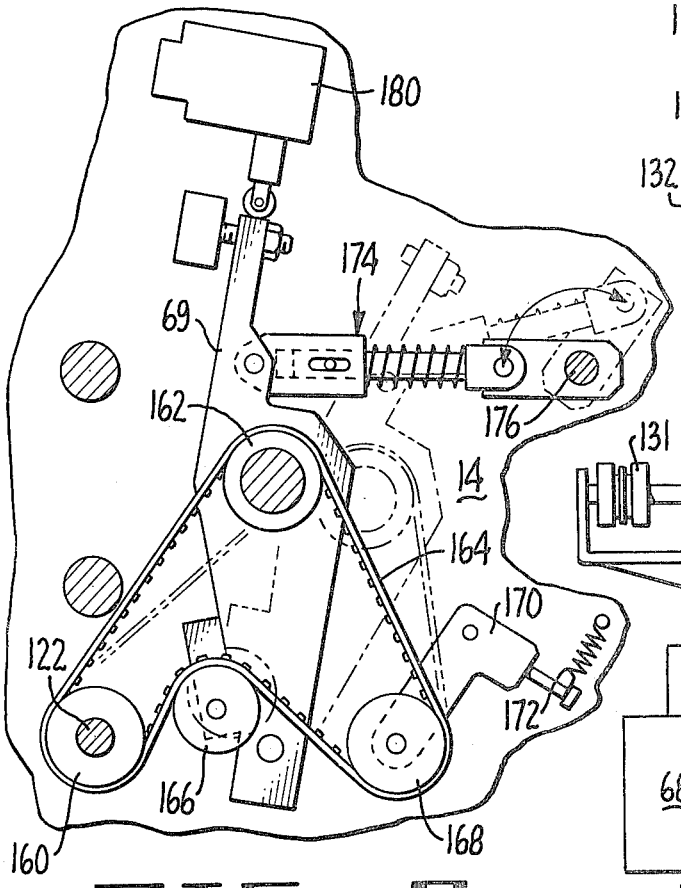
FIG. 7 is a vertical, sectional view, with portions broken away taken generally along the line 7—7 in FIG. 5.
Figure 8:
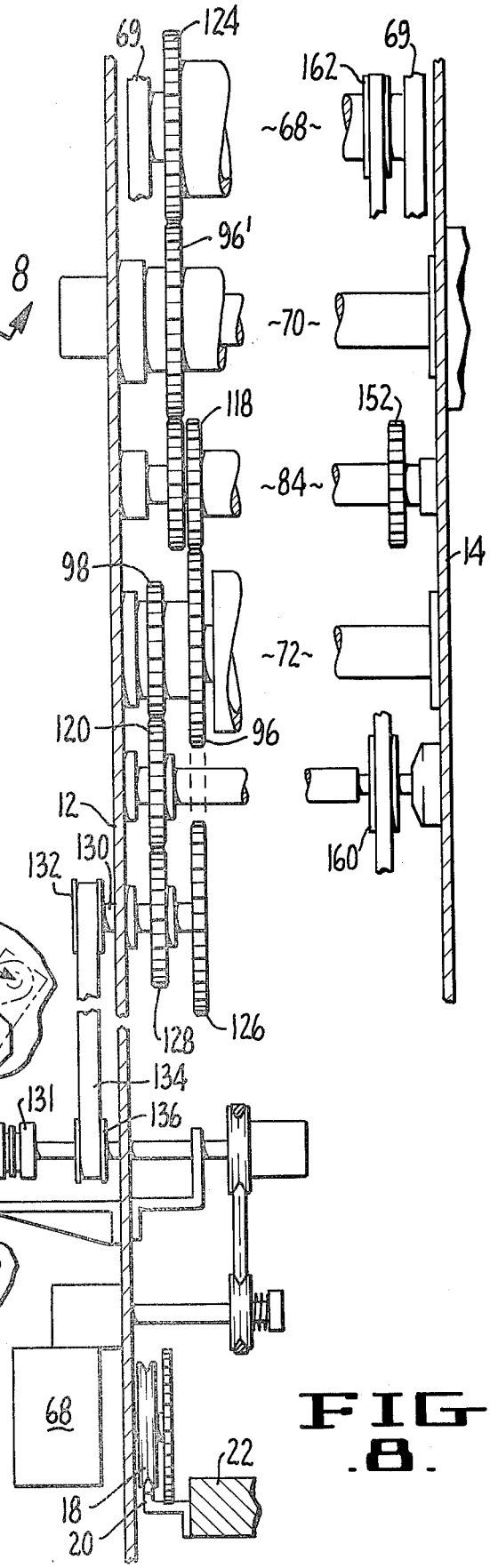
FIG. 8 is a sectional view taken generally along the line 8—8 in FIG. 6.

In order to retain the alignment of the pads 158 with the raised characters 82 when the impression cylinder 68 is swung away from engagement with the printing cylinders in order to initially feed the fabric between the printing cylinders and the impression cylinder, the synchronization shaft 122 has a pulley 160 at its end which is nearest the side plate 14, in which that end is rotatably mounted. The corresponding end of the impression cylinder 68 also has a pulley 162. As best viewed in FIG. 7, a timing belt 164 is entrained around the pulleys 162 and 160 and passes over an idler pulley 166 rotatably mounted at the bottom of the swing arm 69. Slack in the belt 164 is taken up by a pulley 168 which is rotatably mounted on an L-shaped leg 170 which is pivotally mounted to the side plate 14 and which is biased by a spring 172, one end of which is attached to the free leg of the member 170 and the other end of which is attached to the side plate 14.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. An improved shademarker apparatus for printing on a web of fabric as the fabric is spread by a fabric spreading machine, the shademarker being mounted on the fabric spreading machine and having at least one inked, rotatable printing cylinder having raised characters and an opposed impression cylinder, with the fabric web being imprinted with selected characters across its width from the printing cylinder as the fabric web is fed between the printing cylinder and the impression cylinder during spreading of the fabric web wherein the improvement comprises:

means for equalizing tension along the longitudinal edges of the fabric web including raised pads on the circumferential surface of the impression cylinder said fabric web passing about a portion of said impression cylinder so as to engage at least two of said pads whereby tension along the longitudinal edges of the fabric web is equalized when portions of the fabric web which are slack drape between the raised pads and portions of the fabric web which are taut span between circumferentially adjacent raised pads each of the raised pads being positioned to mate with a least one corresponding raised character on the printing cylinder, and means for synchronizing the rotation at the printing cylinder with the rotation of the impression cylinder.

2. An improved fabric shademarker as recited in claim 1, wherein the means for synchronizing the rotation of the printing and impression cylinders comprise motorized means for synchronously rotating the impression and printing cylinders to pull the fabric web through the shademarker.

3. An improved fabric shademarker as recited in claim 2, further comprising means for selecting the circumferential positions of the raised characters on the printing cylinder relative to the corresponding raised pads of the impression cylinder.

4. An improved fabric shademarker as recited in claim 2, wherein the shademarker is further of the type having an inking cylinder with raised ink applying pads on its circumferential surface which is rotated synchronously with and spaced closely parallel to the printing cylinder for cyclically applying ink only to selected characters on the printing cylinder and wherein the improvement further comprises driving the inking cylinder with the motorized means.

5. An improved fabric shademarker as recited in claim 4 wherein the motorized means drives the spreading machine synchronously with the printing and impression cylinders so that the fabric is spread tensionlessly.

6. An improved fabric shademarker as recited in claim 1, wherein the raised characters on the printing cylinder and the raised pads on the impression cylinder are arranged in corresponding helixes.

7. An improved fabric shademarker as recited in claim 1, wherein the raised characters or the raised pads are resilient.

8. An improved fabric shademarker as recited in claim 1, further comprising swing arm means for pivotally mounting the impression cylinder in the shademarker so that the impression cylinder can be swung, from a closed position, closely adjacent to the printing cylinder, to an open position, away from the printing cylinder to allow the fabric web to be introduced between them, and means for maintaining the synchronization between the impression cylinder and the printing cylinder when the impression cylinder is swung between the closed and open positions.

* * * * *